United States Patent [19]

Young et al.

[11] 4,260,291

[45] Apr. 7, 1981

[54] INSTALLATION OF AN OFFSHORE STRUCTURE

[75] Inventors: Charles E. Young, Metairie; Stephen A. Will, Slidell, both of La.

[73] Assignee: J. Ray McDermott & Co., Inc., New Orleans, La.

[21] Appl. No.: 15,730

[22] Filed: Feb. 27, 1979

[51] Int. Cl.[3] ..... E02B 17/02; E02D 21/00

[52] U.S. Cl. ..... 405/205; 405/203; 405/224

[58] Field of Search ..... 405/205, 202, 203, 207, 405/208, 209, 224; 166/342, 341

[56] References Cited

U.S. PATENT DOCUMENTS

| | | | |
|---|---|---|---|
| 2,334,992 | 11/1943 | Crake | 405/205 |
| 2,476,309 | 7/1949 | Lang | 405/205 X |
| 3,097,495 | 7/1963 | Laborde et al. | 405/205 |
| 3,191,201 | 6/1965 | Richardson et al. | 405/202 X |
| 3,220,477 | 11/1965 | Jones | 166/342 X |
| 4,083,193 | 4/1978 | Evans | 405/204 |
| 4,109,476 | 8/1978 | Gracia | 405/169 |
| 4,126,011 | 11/1978 | Lamy et al. | 405/205 X |
| 4,158,516 | 6/1979 | Noblanc et al. | 405/203 X |

FOREIGN PATENT DOCUMENTS 2716948 10/1978 Fed. Rep. of Germany ..... 405/203

*Primary Examiner*—Stephen J. Novosad

*Attorney, Agent, or Firm*—Arnold, White & Durkee

[57] ABSTRACT

In the installation of a jacket or substructure component of an offshore platform on the sea floor over an underwater fixture containing one or more wellheads, a jacket is first ballasted to rest in a vertical orientation on the sea floor. Power winches are mounted atop the jacket above the water line and anchored mooring lines are connected to the winches via fairlead sheaves which define points of attachment for the mooring lines to the jacket. The jacket is deballasted to float with a near sea bottom clearance and is maneuvered horizontally with the power winches toward the underwater fixture. Docking guides carried by the jacket engage vertical guideposts driven drilled into the sea floor at preselected locations relative to the underwater fixture to align the jacket with the underwater fixture. The jacket is then lowered into the desired on-bottom position during controlled ballasting procedures. Finally, piles are driven through hollow jacket columns to anchor the jacket to the sea bottom.

11 Claims, 8 Drawing Figures

FIGURE 1
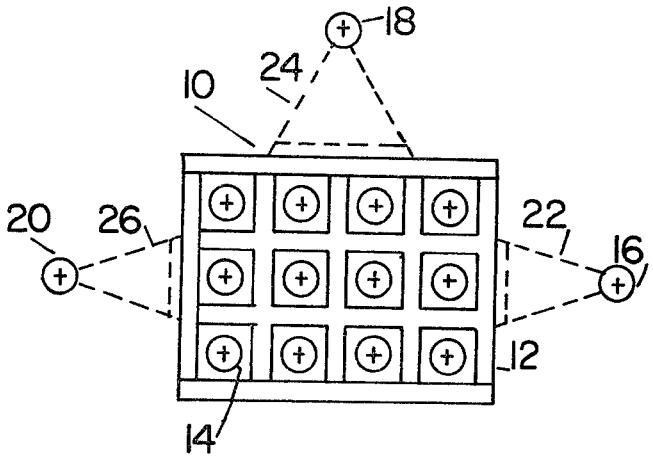
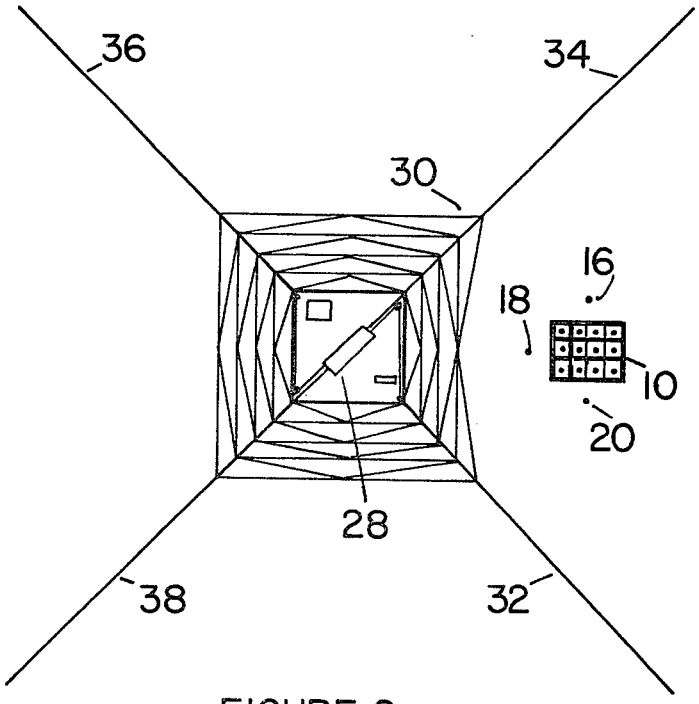
FIGURE 2

FIGURE 6
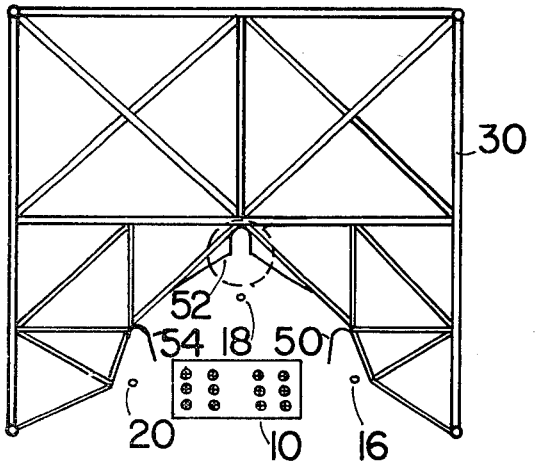
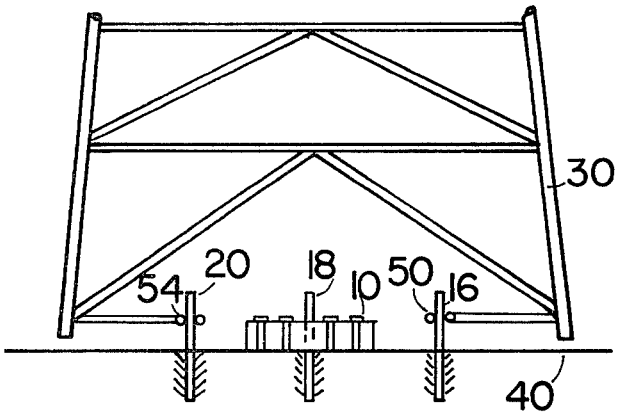
FIGURE 7

INSTALLATION OF AN OFFSHORE STRUCTURE

BACKGROUND OF THE INVENTION

The present invention relates to the installation of offshore structures; and more particularly, it relates to the installation of an offshore structure at a precise offshore location, especially in deep waters at the location of an underwater fixture.

In shallow and relatively calm waters, platform structures supporting hydrocarbon production equipment above the surface of the water are 150–200 feet in height and weigh several hundred tons. Installation of such platform structures has been generally accomplished by hoisting an assembled platform structure with a derrick barge and then lowering the structure vertically to the seabed.

When it is desired to install a fixed platform at a precise location, for example over an underwater wellhead, accurate positioning of the platform is essential. Fixed platform installation procedures, even in shallow waters, therefore, must involve steps to achieve alignment between the platform structure and the underwater fixture. Heretofore, alignment has been achieved by establishing a contacting relation between the platform and the fixture itself to locate the platform in a predetermined lateral position relative to the fixture. The method of docking an offshore structure with a submerged fixture, as disclosed by the prior art heretofore, is to position the structure above the fixture by hoisting means and then to lower the structure downwardly around the fixture with the structure being guided into a predetermined position relative to the fixture, with the necessary guidance being provided by the fixture itself. See, for example, U.S. Pat. No. 4,109,476 entitled "Docking an Offshore Structure with a Submerged Fixture."

With the production of oil and gas resources having moved into deeper waters sometimes over 1,000 feet, platform structures have correspondingly become much larger and heavier. Deep water structures in the North Sea, for example, typically weigh more than 20,000 tons. It is impossible to position such a structure above the submerged fixture with the hoisting means of a derrick barge because of the tremendous weight.

It is known in the art however that predetermined amounts of buoyancy can be built into the structure to offset all or a portion of the weight, thereby making it possible to utilize the hoisting capabilities of a floating vessel, such as a derrick barge. However, such a procedure is also attendant with difficulties when used to position a deep water structure, especially in hostile environments. The environmental forces of current and wave action can produce differential motions of the derrick barge and the suspended structure, thereby imposing severe requirements on the hoisting system. In addition, the limited capability to control lateral movement of the vertically suspended structure is a problem when positioning the structure around the template.

In order to assure that the subsea fixture is properly positioned with respect to the structure, alignment of the structure is required while lowering around the subsea fixture. The art has shown that the fixture itself can be used in a contacting means to guide the structure into the desired position, when dealing with shallower water structures. Using such a procedure with the large deep water structures presents a substantial risk of damage to the subsea fixture, especially in a hostile environment, where the structure is subjected to wind and wave action. If the subsea fixture is a template containing several drilled wells, a contacting of the template by a moving deep water structure could very well mean serious economic and environmental damage.

SUMMARY OF THE INVENTION

The present invention presents a novel approach to the installation of deepwater offshore structures, such as fixed platforms. Moreover, the present invention provides for the placement of a deepwater jacket over an underwater fixture containing predrilled wells, thereby enabling the drilling of the wells to be carried out concurrently with the fabrication of the offshore platform jacket, and making it possible to reduce the lead time required to develop an offshore deepwater oil or gas field. Heretofore, the development of deep water wells has been delayed until an offshore platform is actually located at the field site. Furthermore the present invention provides an installation technique which is relatively risk free from the standpoint of potential damage to either the platform or the fixture, and which can be used successfully in greater water depths and more hostile environments than the installation methods taught by the prior art.

In accordance with the present invention, after fabrication of an offshore structure at an onshore location, the assembled structure is transported to the installation site, at which there may be an underwater fixture containing a predrilled well. The structure is ballasted to an on-bottom vertical position at a selected location near the fixture. With the structure resting on the sea floor, power winches are mounted onto the structure and connected to mooring lines which are anchored to the sea floor. Equipment for monitoring the structure's position during placement maneuvering may also be installed on the structure. The structure is then deballasted to float in a vertical orientation with a near bottom clearance.

Selective actuation of the power winches maneuvers the structure in a horizontal plane and provides for horizontal movement of the structure toward the fixture. The dynamic excursions of the structure caused by current forces and wave action are controlled by the anchored mooring lines attached to the structure at points which provide an optimum relationship between the mooring line forces and the structure excursions. Vertical positioning of the structure is provided by proper ballasting of the structure.

To align the structure with the underwater fixture and provide close range alignment guidance during placement of the structure in exact position over the fixture, alignment means are placed at predetermined locations in the vicinity of, but spaced away from, the underwater fixture. Proper locating of the alignment means ensures that the jacket will be properly located relative to the fixture.

After locating the structure over the fixture using the alignment means, suitable position adjusting devices mounted on the structure may be used to adjust the final alignment of the structure to the fixture if necessary. The final position is secured and selective flooding of the structure is performed to lower the structure to the sea floor. Thereafter, pilings are driven through the structure columns into the sea floor to anchor the structure. The deck sections are lifted and placed onto the structure, and finally the predrilled wells in the fixture are connected to the production equipment on the deck.

Thus, in accordance with the present invention an offshore structure is installed at a precise location on the sea floor by placing alignment means at predetermined locations in the vicinity of the precise location and disposing the offshore structure in a vertical orientation off the sea floor, after which the structure is maneuvered in a horizontal plane toward the alignment means with positioning of the structure at the precise location being achieved using the alignment means.

Moreover, in accordance with the present invention, an offshore structure provided with docking guides is installed over an underwater fixture located on the sea floor in deep waters by placing docking posts at predetermined locations in the vicinity of the fixture and disposing the structure off the sea floor in a vertical orientation. The structure is then moved toward the fixture by maneuvering the structure in a horizontal plane, with the structure being aligned with respect to the fixture by engaging the docking posts with the docking guides on the structure. With the structure so aligned, it is lowered to the sea floor with the docking guides and the docking posts in engagement to maintain alignment of the structure relative to the fixture.

BRIEF DESCRIPTION OF THE DRAWINGS

A more complete understanding of the invention and many of its features will be possible by reference to the following detailed description of an illustrative embodiment in conjunction with the attached drawings in which:

FIG. 1 is a plan view of a multiple completion underwater fixture surrounded by docking posts positioned at prescribed locations;

FIG. 2 is a plan view of an offshore structure positioned adjacent an underwater fixture prior to being horizontally maneuvered into position over the fixture by controlled manipulation of anchored mooring lines;

FIG. 6 is a sectional plan view illustrating in greater detail the alignment means used in the illustrative embodiment for locating the offshore structure over the underwater fixture;

FIG. 7 is a frontal elevation view of the lower end of the offshore structure in FIG. 2 illustrating the structure in the docked position.

DETAILED DESCRIPTION OF AN ILLUSTRATIVE EMBODIMENT

Figure 4:
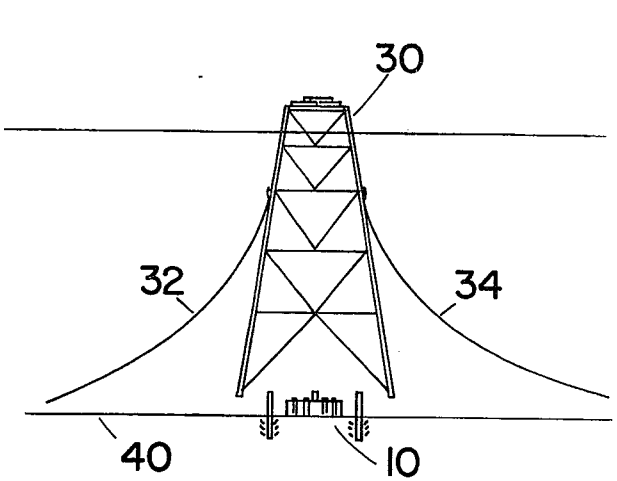
FIG. 4 is a frontal elevation view of the offshore structure shown in FIG. 2 illustrating its docking approach positioning.

Referring first to FIG. 1, there is shown in plan view an underwater fixture 10 containing several wellheads. Fixture 10 comprises a base member 12 positioned on the sea bottom and secured to a number of well casings 14, each of which extends down into a well previously drilled and is cemented therein. Strings of production tubing are suspended within the well casing and extend into the well in the usual manner. Base structure 12 provides for the mounting underwater of a production control unit in fluid communication with the production tubing, the upper ends of which are accessible through base member 12.

As a part of the installation procedure of the present invention, alignment means are placed in the vicinty of the underwater wellhead fixture at predetermined locations. In the illustrative embodiment being described, the alignment means utilized comprises a plurality of vertical guide posts 16, 18 and 20. The placement location of each guide post is established by the use of a respective spacer frame 22, 24, 26. The spacer frames are temporarily fixed to base 12 to establish placement locations for the guide posts which may be piles driven into the sea floor.

After fabrication at a remote onshore shipyard, the jacket of an offshore structure to be installed over the underwater fixture is transported in its assembled form to the offshore installation site. The jacket is then disposed in a vertical orientation and ballasted in an on-bottom position near the fixture. With the jacket resting on the sea floor and the upper end extending above the surface of water, an equipment module comprising power winches and control and position monitoring equipment therefor is mounted atop the jacket. Mooring lines anchored at one end to the sea floor are connected at their opposite ends to an individual one of the power winches.

Referring now to FIG. 2, the plan view therein shows the jacket structure 30 positioned adjacent the underwater fixture with anchored mooring lines 32, 34, 36 and 38 extending radially outward therefrom in a quadrivial arrangement.

Equipment for monitoring jacket position during maneuvering may also be included. Such monitoring equipment, though not shown because of the drawing scale, would include an acoustic positioning system comprising transponders on the seabed, on the jacket structure itself, and on the fixture to provide continuous measurement of position, depth, heading, and attitude. Also, remotely controlled T.V. cameras would be placed on the jacket structure for visual confirmation when the jacket is in very close proximity to fixture 10.

Figure 3:
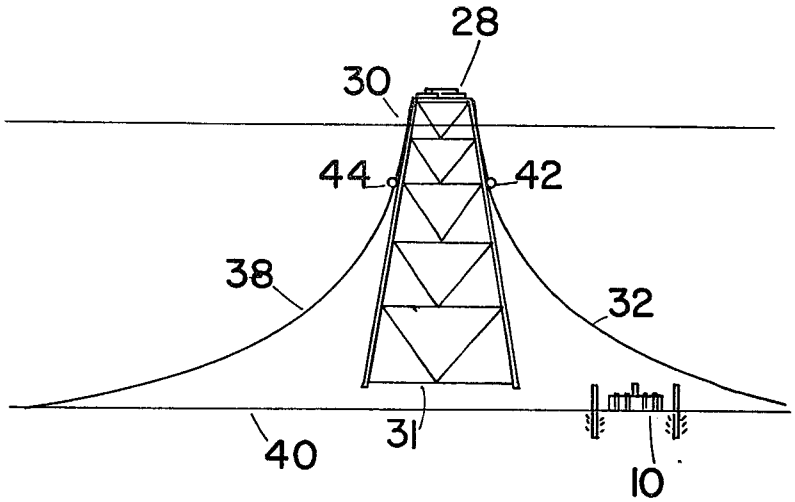
FIG. 3 is a side elevation view of the offshore structure shown in FIG. 2 illustrating its disposition in the water during maneuvering.

Referring next to FIG. 3, after mounting of equipment module 28 and the monitoring equipment, the jacket structure 30 is deballasted so as to float with the lower end 31 a few feet above the sea floor 40. Also, from the view provided in FIG. 3, anchored mooring lines 32 and 38 are shown to be attached to jacket structure 30 by respective fairlead sheaves 42, 44. The sheaves are, of course, mounted at each of the four corners of the jacket structure 30. Moreover, the sheaves are positioned vertically along each corner leg of jacket 30 at points which provide an optimum relationship between mooring line forces and jacket excursions. That is, each sheave is desirably located at a point which affords control of the jacket for maintaining it in a vertical orientation. Accordingly, the exact locations of the attachment points for the sheaves vertically along the jacket structure legs are dependent upon the sea conditions to be encountered at the particular installation site. Jacket excursions are, of course, produced by underwater current forces and by wave action at the surface. After the sea conditions to be encountered are ascertained, calculations can be made to determine the center of resistance to the forces, with the sheaves being located at that point. An extensive discussion of wave mechanics is believed unnecessary to an adequate understanding of the present invention; however, interested readers are referred to the text entitled "Principles of Physical Oceanography" by Gerhard Newmann and Willard J. Pierson, Jr. which discusses the topic.

The docking of jacket structure 30 begins with the structure being at a distance of about 200–300 feet from the underwater fixture over which the jacket is to be installed. Jacket structure 30 is moved horizontally by activating the power winches to pull the structure in the required direction. It will, of course, be understood that both forward advancement toward the underwater fixture and forwardly lateral movement of the jacket structure are attainable with the mooring line arrangement. Also, the jacket structure can be backed away from the underwater fixture, and a new approach started if necessary. FIG. 4 shows the jacket structure 30 after general lateral alignment with underwater fixture 10, after which a direct headon advancement toward the fixture is made.

Figure 5:
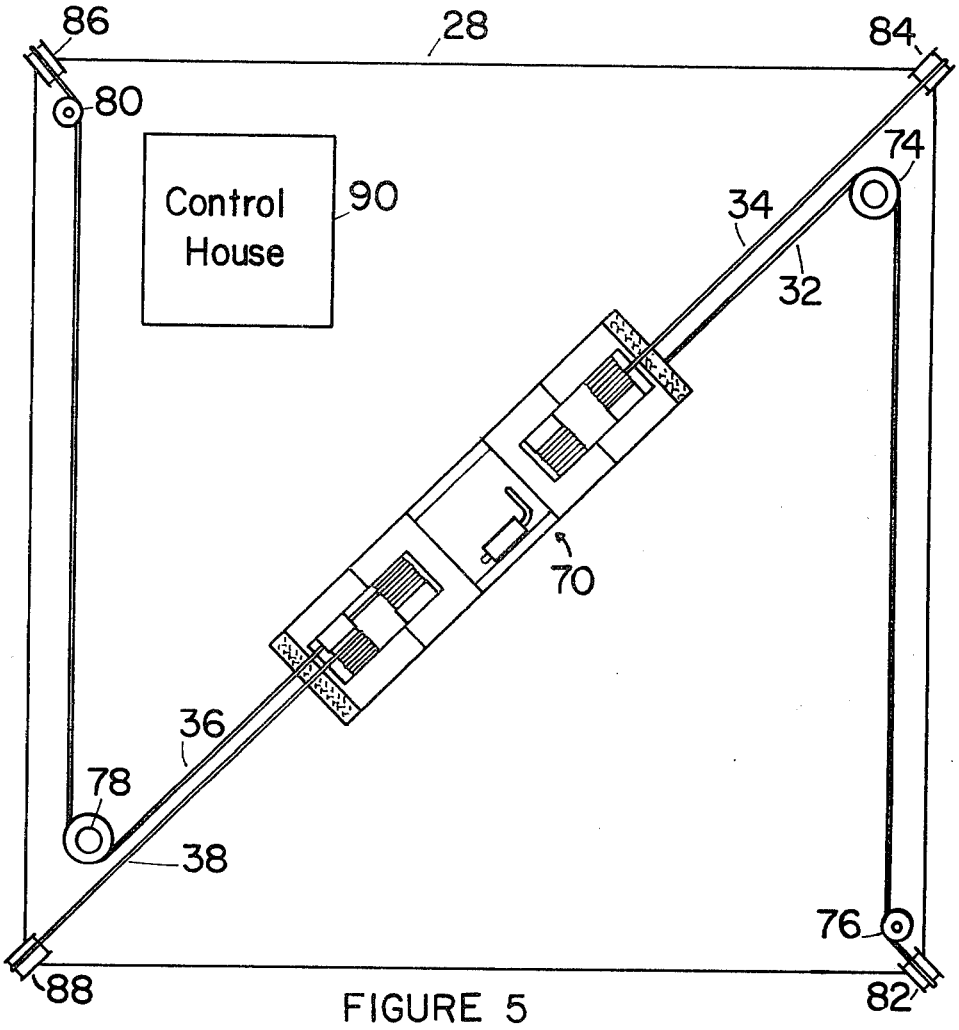
FIG. 5 is a plan view of an equipment module containing power winches mounted atop the offshore structure to provide for horizontal maneuvering of the structure.

Referring briefly to FIG. 5, a more detailed presentation of equipment module 28 is made. The module has a 4-drum power winch unit 70 mounted on a base platform 72 adapted for disposition atop jacket 30. Winch unit 70 is oriented diagonally on platform 72 and centrally positioned. Winch unit 70 may, for example, be an AW-500 series anchor winch manufactured by Victoria Machine Works, Victoria, Tex.

The free ends of mooring lines 32, 34, 36, 38 are each wound about a separate drum of winch unit 70. In order to provide the quadrivial arrangement of the anchored mooring lines, and thereby provide the desired maneuverability of the jacket structure, lines 32 and 36 are routed around intermediate sheaves so as to be positioned at opposite corners of platform 72. As shown, line 32 is routed around intermediate sheaves 74 and 76; line 36 is routed around intermediate sheaves 78 and 80. Because of the diagonal orientation of winch unit 70 on platform 72, lines 34 and 38 extend directly to opposite corners of platform 72.

At each corner of platform 72, a sheave 82, 84, 86, 88 is mounted to provide for the routing of each line down to its respective fairlead sheave on the jacket leg. Also, a control house 90 is carried on platform 72 and contains the controls for winch unit 70 and portions of the guidance monitoring system.

Referring next to FIGS. 6 and 7, a closer and more detailed view of the final docking phase of the installation procedure is provided. In FIG. 6, jacket structure 30, shown in section, has been moved by manipulation of the anchored mooring lines into close proximity of the underwater fixture and alignment means. Since the alignment means utilized in the embodiment illustrated herein comprises vertical piles providing docking posts, jacket structure 30 is provided with docking guides 50, 52 and 54 adapted to mate with the posts. The docking guides are placed within the framework of jacket structure 30 in an arrangement whereby engagement of the docking guides with the docking posts will properly position jacket structure 30 over the fixture. Furthermore, it will be observed from FIG. 6 that a portion of the frame structure on the forward side of jacket structure 30 has been modified to form an archway to permit the jacket to be moved horizontally into position over the fixture.

When docking guides 50, 52 and 54 of jacket structure 30 are properly aligned with docking posts 16, 18 and 20, as shown in FIG. 6, jacket structure 30 is pulled horizontally in the direction of the fixture until the docking guides have engaged the docking posts as shown in FIG. 7. The docking guides are desirably equipped with energy absorbing members (not shown) to dampen the impact forces produced by the dynamic motions of jacket structure 30 upon engagement with the docking posts.

Although docking guides 50, 52 and 54 are shown as being built into the framework of jacket structure 30 at fixed locations, the final horizontal mating tolerance could be decreased by the utilization of position adjusting devices such as jacking mechanisms or the like mounting the docking guides to the jacket. Therefore, after the docking guides have engaged the docking posts, and the jacket structure has been brought close to its target position, jacking mechanisms, if provided, may be actuated to adjust the jacket structure into final alignment with the underwater fixture.

Figure 8:
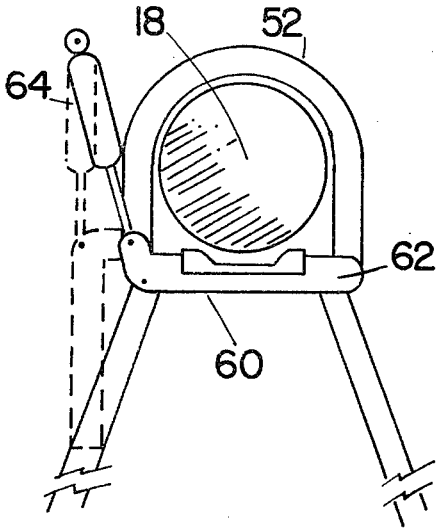
FIG. 8 is a schematic diagram of a mechanism for holding the offshore structure in position after docking.

After final positioning of jacket structure 30, it is secured in position by locking means. In the embodiment shown, the locking means is a stabilizer arm mechanism 60 shown in FIG. 8, which is carried in association with docking guide 52. Stabilizer arm 60 is a hydraulically controlled mechanism for gripping docking post 18 within docking guide 52. Generally, mechanism 60 includes a pivot arm 62 actuatable by a hydraulic cylinder 64 between opened and closed positions, which permit entry of docking posts 18 and prevent its withdrawal therefrom when in the respective positions.

After the jacket is secured, selective ballasting of the structure is then made to lower the jacket to the sea floor. Pilings are then driven through the jacket columns into the sea floor to anchor the structure. Deck sections may then be lifted into place onto the jacket, and the predrilled wells thereafter connected to the production equipment on the platform deck.

The foregoing description of the invention has been directed to a particular embodiment for purposes of explanation and illustration. It will be apparent, however, to those skilled in this art that many modifications and changes in both the apparatus employed and the method described may be made without departing from the essence of the invention. For example, the alignment means providing for precise positioning of the jacket structure 30 with respect to the underwater fixture 10 may be implemented by structure other than piles driven into the sea floor to form vertical poles for engagement by U-shaped docking guides on the jacket. Alternative alignment means may instead comprise a stabbing pole for engagement with a conical or cylindrical alignment guide carried on the jacket structure. Moreover, ultra-sophisticated alignment techniques using lasers and photogrammetry could be adopted to establish alignment between an underwater fixture and a jacket structure. In any event, the alignment means chosen has only to provide for precise alignment or positioning of a structure or the like as it is moved into position without physical contact between the jacket structure and the underwater fixture over which it is to be situated. Also, maneuvering of a floating structure in a horizontal plane could be achieved with a winch and mooring line arrangement other than as shown in the illustrative embodiment. For example, the winches could be carried on an auxiliary structure such as an anchored barge, and the free end of each of several mooring lines connected to the jacket structure. These, and other modifications of the invention will be apparent to those skilled in this art. It is the applicant's intention in the following claims to cover all such equivalent modifications and variations as fall within the scope of the invention.

What is claimed is:

1. A method of installing a deepwater offshore structure comprising a jacket structure over an underwater fixture located on the sea floor in deepwater, comprising the steps of:
   - placing alignment means at predetermined locations around the underwater fixture, the alignment means being disposed substantially below sea level;
   - disposing the jacket structure in a vertical orientation off the sea floor;
   - maneuvering the jacket structure in horizontal movement toward the alignment means; and
   - positioning the jacket structure over the underwater fixture using the alignment means to align the jacket structure with the fixture.

2. The method of claim 1 wherein positioning of the jacket structure over the underwater fixture is by establishing a contacting relation between the jacket structure and the alignment means.

3. The method of claim 1 wherein the alignment means comprises a plurality of docking posts.

4. The method of claim 1 wherein the jacket structure is horizontally maneuvered using power winches which manipulate anchored mooring lines connected to the structure.

5. A method of installing an offshore structure comprising a jacket structure over an underwater fixture located on the sea floor in deep waters, said jacket structure being provided with docking guides, comprising the steps of:
   - placing docking posts at predetermined locations in the vicinity of the fixture and substantially below sea level;
   - disposing the structure off the sea floor in a vertical orientation;
   - moving the structure horizontally toward the fixture;
   - aligning the structure with respect to the fixture by engaging the docking posts with the docking guides on the jacket structure; and
   - lowering the jacket structure to the sea floor with the docking guides and the docking posts in engagement to maintain alignment of the jacket structure relative to the fixture.

6. The method of claim 5 further comprising the step of: securing the structure in the located position over the fixture with means for locking at least one docking post to the structure.

7. A method of installing an offshore structure over an underwater fixture located on the sea floor, said structure being provided with docking guides, comprising the steps of:
   - placing docking posts at predetermined locations in the vicinity of the fixture;
   - ballasting the structure to be disposed in a vertical orientation on the sea floor;
   - erecting an equipment module atop the structure, said module having power winches;
   - connecting anchored mooring lines to the power winches;
   - floating the structure off the sea floor in a vertical orientation;
   - moving the structure toward the fixture by maneuvering the structure in a horizontal plane using the power winches and anchored mooring lines;
   - guiding the structure into position over the fixture by engaging the docking posts with the docking guides on the structure;
   - securing the structure in position over the fixture by locking at least one docking post to the structure; and
   - lowering the structure to the sea floor with the docking guides and the docking posts in engagement to maintain the position of the structure relative to the fixture.

8. An offshore structure for installation in deepwater over an underwater fixture, comprising:
   - a jacket structure, said jacket structure having an archway formed therein to provide for horizontal movement of the structure into position over a fixture;
   - guide means carried on said jacket structure for engaging alignment means positioned in predetermined locations on the sea floor in the vicinity of the underwater fixture and disposed substantially below sea level, said guide means providing for engagement of the alignment means upon horizontal movement of the structure toward the alignment means; and
   - means for maneuvering said jacket structure horizontally.

9. The structure of claim 8 further comprising:
   - means carried on said jacket structure for encapturing the alignment means within said guide means.

10. The structure of claim 8 wherein said guide means are mounted on said jacket structure within the archway formed in said jacket structure.

11. The structure of claim 8 wherein said horizontal maneuvering means comprises power winches mounted atop said jacket structure and anchored mooring lines connected thereto.

* * * * *